US007077930B2

(12) United States Patent
Ämmälä et al.

(10) Patent No.: US 7,077,930 B2
(45) Date of Patent: Jul. 18, 2006

(54) METHOD FOR CONTROLLING SCREENING BY MEASURING FLOW AMOUNT CONSISTENCY OF THE PULP

(75) Inventors: Ari Ämmälä, Oulu (FI); Jouko Niinimäki, Oulu (FI); Tero Jussila, Tampere (FI)

(73) Assignee: Metso Paper Inc., Helsinki (FI)

( * ) Notice: Subject to any disclaimer, the term of this patent is extended or adjusted under 35 U.S.C. 154(b) by 9 days.

(21) Appl. No.: 10/641,841

(22) Filed: Aug. 15, 2003

(65) Prior Publication Data

US 2004/0031577 A1 Feb. 19, 2004

Related U.S. Application Data

(63) Continuation of application No. PCT/FI02/00186, filed on Mar. 8, 2002.

(30) Foreign Application Priority Data

Mar. 9, 2001 (FI) ..... 20010482

(51) Int. Cl.
*D21D 5/02* (2006.01)

(52) U.S. Cl. ..... 162/49; 162/55; 162/27

(58) Field of Classification Search ..... 162/23, 162/28, 49, 55, 61, 198, 254, 258; 210/739; 209/13, 17
See application file for complete search history.

(56) References Cited

U.S. PATENT DOCUMENTS 4,342,618 A * 8/1982 Karnis et al. ..... 162/49
5,491,340 A * 2/1996 Saarinen ..... 250/339.06
6,032,885 A 3/2000 Ellery
6,080,274 A 6/2000 Hautala et al.
2003/0041984 A1 3/2003 Jussila et al.
2004/0031577 A1* 2/2004 Ammala et al. ..... 162/49

FOREIGN PATENT DOCUMENTS

| | | | |
|---|---|---|---|
| EP | 0 422 314 | | 4/1991 |
| FI | 102550 | | 12/1998 |
| WO | WO 93/25752 | * | 12/1993 |
| WO | WO 200272947 A1 | * | 9/2002 |

OTHER PUBLICATIONS

Erkki Aalto; *Puumassan Valmistus*; 1968; pp. E2 50-54; Helsinki.
Copy of International Search Report for PCT/FI02/00186 completed May 30, 2002.
Copy of Official Action for Finnish Priority Appl. No. 20010482 dated Sep. 28, 2001.

* cited by examiner

*Primary Examiner*—Joseé A. Fortuna
(74) *Attorney, Agent, or Firm*—Alston & Bird LLP

(57) ABSTRACT

The invention relates to a method of controlling quality of pulp. Pulp formed in mechanical defibering of wood is screened into at least two fractions, the accept that has passed the screening phase being forwarded for further use and the reject that did not pass the screening being removed from the screening phase. The invention comprises determining flow amount and consistency of the pulp supplied to the screening phase and, correspondingly, of the reject removed therefrom, and calculating a passage ratio of the reject and the supplied pulp by means of the flow amounts and consistency values verified through the measurement, and adjusting the screening phase according to said passage ratio.

5 Claims, 1 Drawing Sheet

METHOD FOR CONTROLLING SCREENING BY MEASURING FLOW AMOUNT CONSISTENCY OF THE PULP

CROSS-REFERENCE TO RELATED APPLICATIONS

This application is a continuation of International Patent Application PCT/FI02/00186 filed Mar. 8, 2002, which designated the United States and was published under PCT Article 21(2) in English, and which is hereby incorporated herein in its entirety by reference.

BACKGROUND OF THE INVENTION

1) Field of the Invention

The invention relates to a method of controlling quality of pulp produced by mechanical defibering and by screening the pulp thereby obtained to provide at least two fractions, the accept that has passed the screening phase being carried forward for later use and the reject that has not passed the screening phase being led out of the screening phase.

2) Description of Related Art

In modern fiber processes of paper and board manufacture, the formed pulp is screened under pressure to keep the quality of the accepted pulp, i.e. accept, uniform. This may be carried out by controlling the amount of mass, i.e. the level of the mass surface, in the feeder or accept containers in the screening. Other alternatives include adjustments based on screening pressure and mass flow. In principle, these methods only control the capacity of the screening which is not, as such, in any way directly proportional to the quality of the screened pulp. Another way to control the screening such that the quality of the accepted pulp is also maintained as uniform as possible, irrespective of capacity variations, is based on adjusting the values of the flow-to-reject ratio and the feed consistency of the pulp supplied to the screening.

Although the adjustments used in prior art process control methods may be applied in standard conditions, they cannot be used for controlling the screening process in exceptional circumstances, for example in grade changes when the freeness value of the accept is to be changed or when the screening process is started up/shut down. Consequently, the quality of the pulp to be supplied to the screening process varies significantly, thereby affecting the further processes and the quality of the fiber web made of the pulp. The variations may be considerable, and the control of the screening process is substantially dependent on the process quality measurements. The prior art control parameters, such as the mass-to-reject ratio between the reject and the supplied pulp, are not sufficient to properly control changes in the quality of the accept. Even though there are ways to change the quality of the accept, the magnitude of the change cannot be predicted prior to the change. Consequently, the changes must always be followed by laboratory tests on the quality of the accept, such as the freeness value, fiber length distribution and fiber flexibility.

BRIEF SUMMARY OF THE INVENTION

An objective of the present invention is to provide a new and improved method of controlling, more accurately than before, the quality of pulp leaving a screen room, the method also taking into account diverse sudden variations. The method according to the invention is characterized by determining flow amount and consistency of the pulp to be supplied to the screening phase and, correspondingly, of the reject removed from the screening phase, and calculating, based on the flow amounts and consistency values, a passage ratio of the reject and the supplied pulp, and adjusting the screening phase according to said passage ratio.

The invention is based on determining properties of the pulp supplied to screening and of the reject leaving the screening process, and adjusting the screening result by means of these properties. An advantage of the invention is that, irrespective of variations in the properties of the pulp to be supplied, the properties of the accept can be kept constant better than before, and the quality of the accept can be changed to a desired extent, since measurement of flow and consistency values provides a reliable manner of determining the change in the quality of the accept. This also improves the quality of the further processes and of the fiber web to be produced. A preferred embodiment of the invention is based on adjusting one or more screening phases on the basis of the passage ratio of one screening phase. According to another preferred embodiment of the invention, passage ratios of several screening phases are used to adjust one screening phase.

BRIEF DESCRIPTION OF THE DRAWING

The invention will be described in more detail in the accompanying drawing, in which

FIG. 1 shows the invention in a simplified manner.

DETAILED DESCRIPTION OF THE INVENTION

Figure 1:
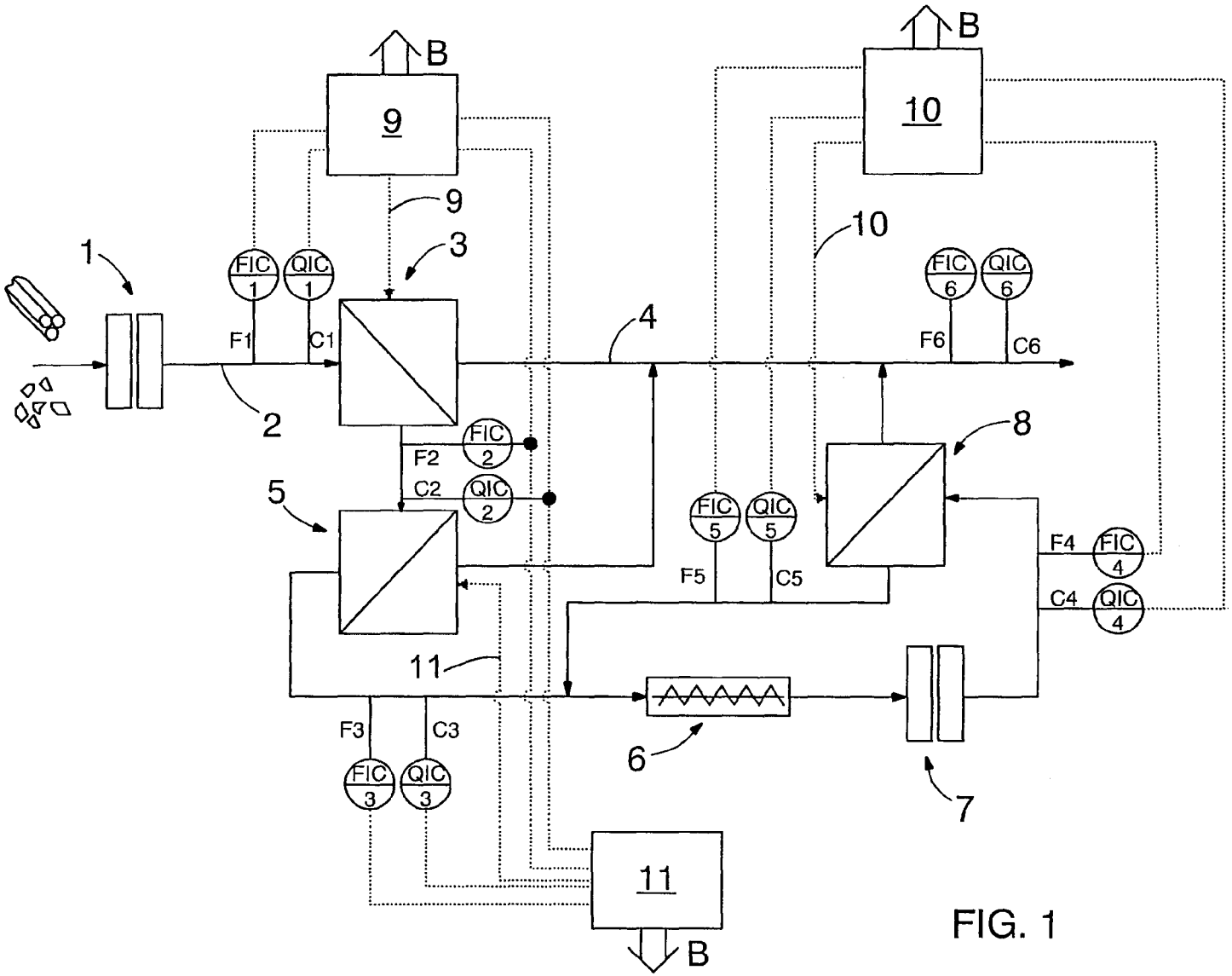
FIG. 1 shows schematically screening and adjustment of pulp supplied from mechanical defibering in a screen room according to the invention.

In FIG. 1, pulp is produced in the presence of water in a primary defibrator 1 either by grinding logs, refining wood chips or by pulping or refining fiber material, depending on whether the primary defibrator 1 is a grinding machine, a refiner or a pulper. The fiber material can consist of recycled fiber, reject of a fiber web formed in a further process, or some other fibrous raw material. There may be one or more primary defibrators 1, and they may be all alike or, if necessary, different types of primary defibrators may be used to form a primary defibrator entity, hereinafter referred to as a primary defibrator.

From the primary defibrator 1 the pulp is carried via a feed conduit 2 to a first screening phase 3 where it is divided into two fractions. The accepted mass fraction, or the accept, is led to a discharge conduit 4, whereas the rejected mass fraction, or the reject, is led to a second screening phase 5. The accepted mass fraction, or the accept, obtained from the second screening phase is again led to the discharge conduit 4 and the rejected fraction, or the reject, is carried forward to a thickener 6 and then to a defibrator, i.e. a reject refiner 7. The reject refined in the reject refiner 7 is then supplied to a reject screening phase 8, and the obtained accepted mass fraction is led to the discharge conduit 4 and, correspondingly, the reject is fed together with the reject from the second screening phase to the thickener 6 and then again to the reject refiner 7.

As shown in FIG. 1, flow amounts and consistency values $F_1$ and $C_1$ of the pulp to be fed are measured using measuring sensors $FIC_1$ and $QIC_1$ to obtain the amount of incoming pulp. In addition, flow amount $F_2$ and consistency $C_2$ of the reject leaving the first screening phase 3 is measured using measuring sensors $FIC_2$ and $QIC_2$ to allow the reject ratio produced in the first screening phase to be calculated. After the second screening phase 5, flow amount $F_3$ and consistency $C_3$ of the reject are measured using measuring sensors $FIC_3$ and $QIC_3$. Flow amount $F_4$ and consistency $C_4$ of the pulp to be supplied to the reject screening phase are then measured after the reject refiner 7 using measuring sensors $FIC_4$ and $QIC_4$, and flow amount $F_5$ and consistency $C_5$ of the reject leaving the reject screening are measured using measuring sensors $FIC_5$ and $QIC_5$, to provide sufficient values for controlling the entire defibering process. Furthermore, flow amount $F_6$ and consistency $C_6$ of the pulp flowing to the paper machine via the discharge conduit 4 may be measured using measuring sensors $FIC_6$ and $QIC_6$, and the values thereby obtained may be used for monitoring the adjustments and the rest of the process. FIG. 1 also shows control unit 9, to which the measuring sensors of the reject of the first screening phase 3 and the pulp to be fed are connected, the unit itself being connected to control the first screening phase 3, as shown by line 9. The figure also includes control unit 10, to which measuring sensors of the pulp coming from the reject refiner 7 to be supplied to the reject screening phase 8 and, correspondingly, the reject mass leaving the reject screening phase are connected, the unit being connected to control the reject screen 8, as shown schematically by line 10. FIG. 1 further includes control unit 11, to which measuring sensors for the reject coming from the second screening phase 5 and for the pulp to be supplied to the screening phase 5 are connected. Control unit 11 is further connected to control the screen 5, as shown schematically by line 11. Instead of the measurement of flow amount, also methods indirectly determining the flow amount may be used, such methods being based on pressure loss, for example, or on some other known physical phenomenon. Such methods for determining flow are commonly known and therefore they do not need to be described in greater detail in this context.

Changes in the measurements of consistency $C_2$ of the reject in the first screening phase allow to deduct that the quality of the pulp coming from the primary defibrator 1 to the first screening phase 3 is changing. Control unit 9 can thus use the measurement of consistency $C_2$ alone to control the first screening phase 3 such that the quality of the pulp regains its original value. Changes taking place in the consistency may also cause corresponding changes in the quality of the pulp material supplied to the reject refiner 7. The reject refiner 7 can then be adjusted, if desired, so that the quality of the accept leaving the reject screening phase 8 remains substantially unchanged. Similarly, any changes in consistency $C_5$ observed by measuring the consistency of the reject leaving the reject screening phase 8 may be used for controlling the reject refiner 7 such that the quality of the pulp leaving the refiner and supplied to the reject screening phase remains substantially as desired.

In addition to applying control based on the measurement of consistency alone, the reject flow may be determined, either by directly measuring the flow or indirectly by measuring pressure loss, or by using some other suitable measurement method. This allows changes both in consistency and flow to be used as a basis of the screen adjustments. Furthermore, the consistency of the pulp to be fed to the screening phase and the reject consistency may be measured to control the screens on the basis of the consistencies. According to a preferred embodiment, the values of both the reject consistency and flow and, correspondingly, the values of the consistency and flow of the pulp to be fed to the screening phase are used to calculate a passage ratio.

The control units 9, 10 and 11 in FIG. 1 are further provided with an arrow marked with letter B to indicate that the control units may be interconnected in a suitable manner to provide a control unit entity that allows comprehensive control of the screens to be implemented. The control units may also be connected to a general control and monitoring system in the manufacturing plant to appropriately control and monitor the entity.

The first screening phase 3 can be controlled using the reject ratio of the first screening phase 3. For this purpose, a mass-to-reject ratio is first calculated on the basis of flow amounts $F_1$ and $F_2$ and consistency values $C_1$ and $C_2$ from the formula $$RR_m = \frac{C_R F_R}{C_F F_F} \tag{1}$$

wherein $RR_m$=mass-to-reject ratio $F_R$=amount of reject flow ($dm^3/s$)

$F_F$=amount of flow of pulp fed ($dm^3/s$)

$C_R$=consistency of reject (%)

$C_F$=consistency of pulp fed (%).

Accordingly, the mass-to-reject ratio $RR_{m1}$ for the first screening phase 3 is calculated from the formula $$RR_{m1} = \frac{C_2 F_2}{C_1 F_1} \tag{2}$$

wherein $C_1$=consistency of first screening phase 3 (%)

$C_2$=consistency of reject from first screening phase 3 (%)

$F_1$=amount of flow of pulp fed to first screening phase 3 ($dm^3/s$)

$F_2$=amount of flow of reject from first screening phase 3 ($dm^3/s$).

The volume-to-reject ratio $RR_v$ of the first screening phase 3 can be determined from the formula $$RR_v = \frac{F_R}{F_F} \tag{3}$$

wherein $RR_v$=volume-to-reject ratio $F_R$=amount of flow of reject ($dm^3/s$)

$F_F$=amount of flow of pulp fed ($dm^3/s$).

Thus, the volume-to-reject ratio of the first screening phase 3 is calculated from the formula $$RR_{v1} = \frac{F_2}{F_1} \tag{4}$$

wherein $RR_{v1}$=volume-to-reject ratio of first screening phase 3

$F_1$=amount of flow of pulp fed to first screening phase 3 ($dm^3/s$)

$F_2$=amount of flow of reject from first screening phase 3 ($dm^3/s$).

The passage ratio of the first screening phase 3 can be determined from the formula $$P_1 = \frac{\log(RR_{m1})}{\log(RR_{v1})} \quad (5)$$

wherein $P_1$=passage ratio of first screening phase 3

$RR_{m1}$=mass-to-reject ratio of first screening phase 3

$RR_{v1}$=volume-to-reject ratio of first screening phase 3.

The passage value thus calculated can be used to control the first screening phase 3 by means of control unit 9. This is implemented by transmitting the values measured by measuring sensors $FIC_{1-2}$ and $QIC_{1-2}$ to control unit 9, which carries out the calculations.

The second screening phase 5 can be controlled by means of the reject ratio of the second screening phase 5. For this purpose, the reject ratio is first calculated based on the flow amounts $F_2$ and $F_3$ and consistency values $C_2$ and $C_3$. The mass-to-reject ratio $RR_{m2}$ of the second screening phase 5 is calculated as follows from formula (1)

$$RR_{m2} = \frac{C_3F_3}{C_2F_2} \quad (6)$$

wherein $RR_{m2}$=mass-to-reject ratio of second screening phase 5

$C_2$=consistency of pulp fed to second screening phase 5 (%)

$C_3$=consistency of reject from second screening phase 5 (%)

$F_2$=amount of flow of pulp fed to second screening phase 5 (d $m^3$/s)

$F_3$=amount of flow of reject from second screening phase 5 ($dm^3$/s).

The volume-to-reject ratio of the second screening phase 5 is calculated from formula (3)

$$RR_{v2} = \frac{F_3}{F_2} \quad (7)$$

wherein $RR_{v2}$=volume-to-reject ratio of second screening phase $F_2$=amount of flow of pulp fed to second screening phase 5 ($dm^3$/s)

$F_3$=amount of flow of reject from second screening phase 5 ($dm^3$/s).

The passage ratio of the second screening phase 5 can be determined as follows from the formula $$P_2 = \frac{\log(RR_{m2})}{\log(RR_{v2})} \quad (8)$$

wherein $P_2$=passage ratio of second screening phase 5

$RR_{m2}$=mass-to-reject ratio of second screening phase 5

$RR_{v2}$=volume-to-reject ratio of second screening phase 5.

The passage value thus calculated can be used to control the second screening phase 5 by means of control unit 11. This is implemented by transmitting the values measured by the measuring sensors $FIC_{2-3}$ and $QIC_{2-3}$ to control unit 11, which carries out the calculations.

The reject screening phase 8 can be adjusted by means of the reject ratio of the reject screening phase 8. For this purpose, the reject ratio is first calculated by means of the flow amounts $F_4$ and $F_5$ and consistency values $C_4$ and $C_5$. The mass-to-reject ratio $RR_{m3}$ of the reject screening phase 8 is calculated from formula (1)

$$RR_{m3} = \frac{C_5F_5}{C_4F_4} \quad (9)$$

wherein $RR_{m3}$=mass-to-reject ratio of reject screening phase 8

$C_4$=consistency of pulp fed to reject screening phase 8 (%)

$C_5$=consistency of reject from reject screening phase 8 (%)

$F_4$=amount of flow of pulp fed to reject screening phase 8 ($dm^3$/s)

$F_5$=amount of flow of reject from reject screening phase 8 ($dm^3$/s).

The volume-to-reject ratio of the reject screening phase 8 is calculated from formula (4)

$$RR_{v3} = \frac{F_5}{F_4} \quad (10)$$

wherein $RR_{v3}$=volume-to-reject ratio of reject screening phase 8

$F_4$=amount of flow of pulp fed to reject screening phase 8 ($dm^3$/s)

$F_5$=amount of flow of reject from reject screening phase 8.

The passage ratio of the reject screening phase 8 can be determined from the formula $$P_3 = \frac{\log(RR_{m3})}{\log(RR_{v3})} \quad (11)$$

wherein $P_3$=passage ratio of reject screening phase 8

$RR_{m3}$=mass-to-reject ratio of reject screening phase 8

$RR_{v3}$=volume-to-reject ratio of reject screening phase 8

The passage value thus calculated can be used to control the reject screening phase 8 by means of control unit 10. This is implemented by transmitting the values measured by measuring sensors $FIC_{4-5}$ and $QIC_{4-5}$ to control unit 10, which carries out the calculations.

Each of the control units 9, 10, 11 thus forms a separate entity controlling the operation of a specific screening phase, on the basis of which they determine the quality of the pulp. This allows the screening of pulp to be controlled to ensure desired quality and, correspondingly, to maintain the quality substantially constant. In practice the control units 9, 10, 11 may be integrated in one and the same control equipment and/or they may form for example a part of a controller provided with software and used for managing the process as a whole.

FIG. 1 shows typical three-phase screening in a screen room, in which the pulp is screened in two consecutive screening phases or screens, and the obtained reject is then screened in a separate reject screening phase. However, the basic idea of the invention may also be applied in other kinds of screen rooms, in which the properties of the accept and reject can be measured or determined following the described principle. The different screening phases may comprise either separate screens or multi-phase screens forming one entity, or other kinds of screen combinations. The control units may be connected to control the screens either directly or according to the principle of the aforementioned bus B, a specific screen being controlled either by a single control unit or the impact of several control units being taken into account. By way of example, control unit 9 may thus provide 70% of the control of the first screening phase 3, control unit 10 providing 20% and control unit 11 10%. Different decisions regarding whether percent adjustments or relative adjustments are applied can be made, as need arises, so that the equipment as a whole is taken into account, which allows the best possible result to be obtained with regard to any desired quality characteristic of the pulp. As shown in FIG. 1, changes in the passage ratio may be similarly considered proportional to other mass properties, such as the proportion of long fibers in the mass, mass strength, etc. The passage ratio can thus be used, when desired, also for controlling these quality values of the pulp.

The invention is described in the above specification and the related drawing only by way of example, without being restricted thereto. Furthermore, due to the arrangement according to the invention the entire fiber process of paper and board manufacture can be monitored and adjusted using flow and consistency values, energy consumption levels characteristic of process equipment, and flow dilutions of process equipment as control parameters for obtaining desired quality values for pulp. The essential aspect is that the flow and consistency of the pulp entering the screening phase are measured in the screening and that, correspondingly, the flow and consistency of the fraction rejected from the screening, i.e. the reject, are measured as well, the measurement values thus obtained being used to control the screening so as to allow substantially desired quality characteristics, such as a freeness value, fiber length and fiber flexibility, to be obtained for the pulp fraction accepted in the screening.

What is claimed is:

1. A method of controlling quality of pulp comprising;

producing the pulp by mechanical refining, screening the pulp thereby obtained at a screening phase to provide at least two fractions, the accept that has passed the screening phase being carried forward for later use and reject that has not passed the screening phase being led out of the screening phase, determining flow amount and consistency of the pulp to be supplied to the screening phase, and correspondingly, of the reject removed from the screening phase, calculating, based on the flow amounts and consistency values, a passage ratio of the reject and the supplied pulp using the formula $$P = \frac{\log(RR_m)}{\log(RR_v)}$$

wherein P is the passage ratio, $RR_m$ is the mass-to-reject ratio of the screening phase, and $RR_v$ is the volume-to-reject ratio of the screening phase, and adjusting the screening phase according to said passage ratio.

2. A method according to claim 1, wherein the flow amount and consistency of the pulp to be supplied to the screening phase and, correspondingly, of the reject removed from the screening phase are verified by means of measurements.

3. A method according to claim 1 wherein the passage ratio of one screening phase is used to adjust one or more of the other screening phases.

4. A method according to claim 1, wherein the passage ratios of several screening phases are used to adjust one screening phase.

5. A method according to claim 1, wherein the screening phase is adjusted in accordance with a freeness value and/or fiber length and/or fiber flexibility of the accept.

* * * * *